US009644278B2

(12) United States Patent
Manojlovich

(10) Patent No.: US 9,644,278 B2
(45) Date of Patent: May 9, 2017

(54) RECYCLING HYDROGEN GENERATOR

(71) Applicant: Barbara Jean Manojlovich, Little Switzerland, NC (US)

(72) Inventor: Barbara Jean Manojlovich, Little Switzerland, NC (US)

( * ) Notice: Subject to any disclaimer, the term of this patent is extended or adjusted under 35 U.S.C. 154(b) by 0 days.

(21) Appl. No.: 14/544,986

(22) Filed: Mar. 13, 2015

(65) Prior Publication Data

US 2016/0265124 A1 Sep. 15, 2016

(51) Int. Cl.

| | |
|---|---|
| ***C25C 7/00*** | (2006.01) |
| ***C25B 15/08*** | (2006.01) |
| ***C25B 9/06*** | (2006.01) |
| ***C25B 1/34*** | (2006.01) |

(52) U.S. Cl.

CPC ..... *C25B 15/08* (2013.01); *C25B 1/34* (2013.01); *C25B 9/06* (2013.01)

(58) Field of Classification Search

CPC ..... Y02E 60/36
USPC ..... 204/242; 429/408, 418; 205/637, 639
See application file for complete search history.

(56) References Cited

U.S. PATENT DOCUMENTS 3,899,403 A * 8/1975 Cook, Jr. ..... C25B 13/02 205/345
4,781,810 A * 11/1988 Tucker ..... C02F 1/4674 204/228.2
5,693,213 A * 12/1997 Shimamune ..... C25B 1/46 205/510
5,879,521 A * 3/1999 Shimamune ..... C25B 9/08 204/252
2004/0146754 A1* 7/2004 Arthur ..... B01J 7/00 422/198
2011/0094894 A1* 4/2011 Mason ..... B01J 7/02 205/637
2011/0162964 A1* 7/2011 Freydina ..... C02F 1/469 204/519
2012/0171530 A1* 7/2012 Lee ..... B60L 11/005 429/70

OTHER PUBLICATIONS

Beginning Claim Drafting.*
Advanced Claim Drafting.*
Substitute Specification Examples Marked-Up and Clean Version.*
Substitute Specification Coverletter with No new matter.*
"Manojlovich: Research, Inventions, Philosophy, Literature", All treatures of Nature, Copyright 1977.*

* cited by examiner

*Primary Examiner* — Nina Bhat

(57) ABSTRACT

The recycling hydrogen generator comprises a chlorine filtration and safety feature system wherein alternative size and type housing compartments, anodes, cathodes and an attached vibration system recycle or remix electrolyte residue for use as new electrolyte and permit the free passage of hydrogen into the external storage tank with electric cut-off switch safety feature for control of the rate and amount of hydrogen produced for individual and home use, and wherein the breakable window safety feature instantly remixes said dangerous chlorine gases with said liquid electrolytic residue in case accident endangers the said housing.

5 Claims, 3 Drawing Sheets

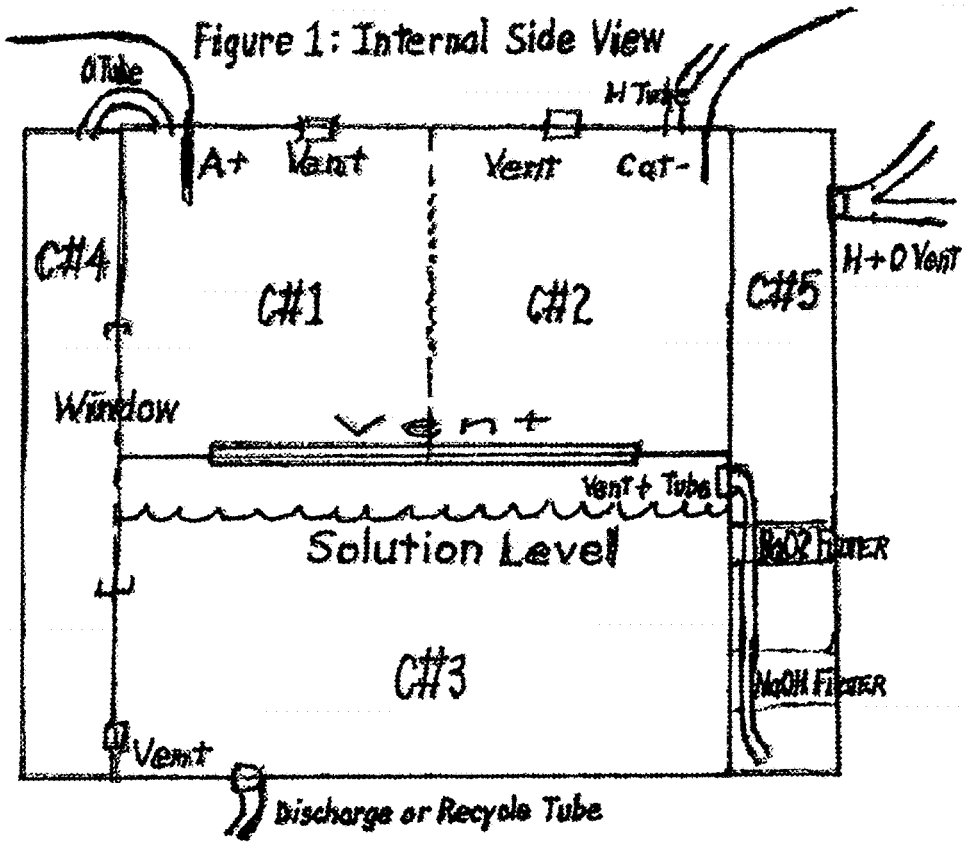
Figure 1: Internal Side View
O Tube
H Tube
A+
Vent
Vent
Cat-
C#4
C#1
C#2
C#5
H+O Vent
Window
Vent
Vent+ Tube
Solution Level
NaOH Filter
C#3
Vent
Discharge or Recycle Tube FIGURE 2: SIDE VIEW
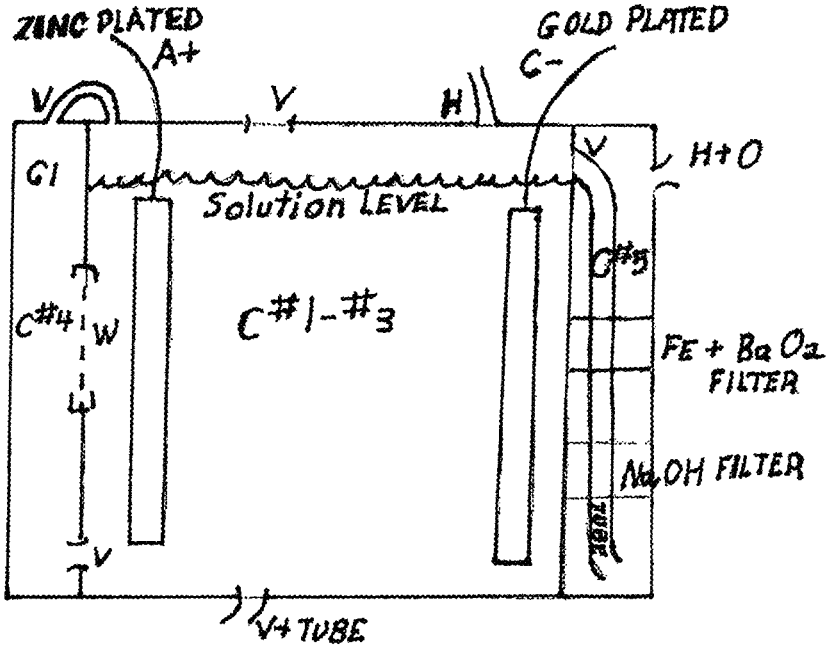
FIGURE 3: TOP VIEW
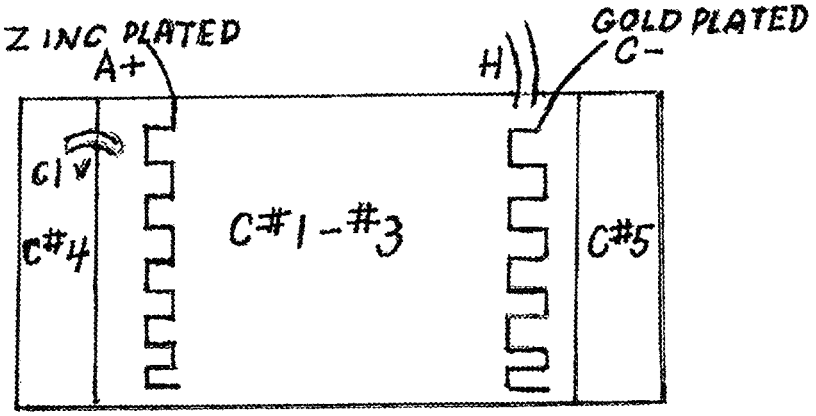

FIGURE 4: SIDE VIEW
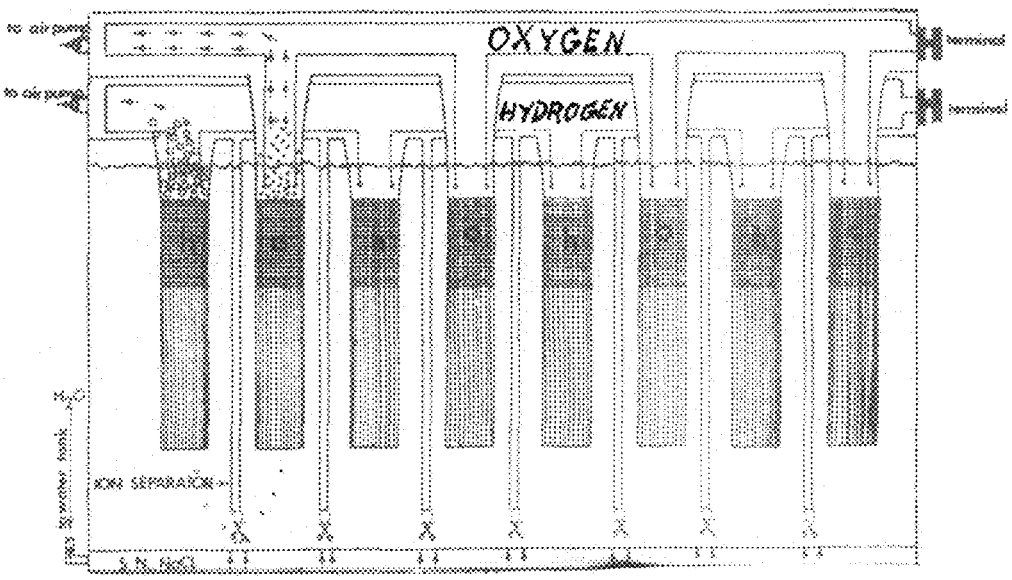
FIGURE 5: END VIEW
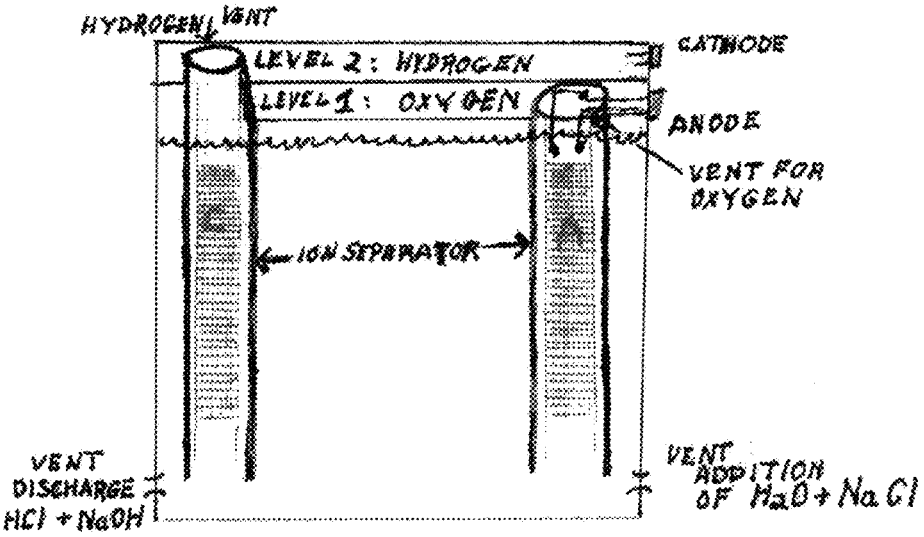

RECYCLING HYDROGEN GENERATOR

CROSS-REFERENCE TO RELATED APPLICATIONS

Not Applicable

FEDERALLY SPONSORED

Not Applicable

NAMES OF PARTIES TO JOINT RESEARCH AGREEMENT

Not Applicable

COMPACT DISC OR TEXT FILE (EFS-WEB)

Not Applicable

STATEMENT OF PRIOR DISCLOSURES

Not Applicable

BACKGROUND OF THE INVENTION

1.) Field of Invention

Hydrogen generator

2.) Description of Related Art

A) U.S. Pat. No. 899,403A; Date August, 1975, Cook, Jr., Edward H.

B) U.S. Pat. No. 9,217,203, Date December, 2015, Gotheil-Yelle, Scott

C) Published Ref.: "21 Years of Creative Work" by George Manojlovich, copyrighted 1977, pages 42-48 (Copy enclosed)

BRIEF SUMMARY

The Recycling Hydrogen Generator is a safety compliant, flexible combination of filters and compartments for removing sodium and chlorine from the electrolysis process of generating hydrogen from water by remixing or recycling the NaOH+HCl residue into NaCl+$H_2O$ for reuse as new recycled electrolyte, preventing dangerous chlorine gases from entering the atmosphere, and allowing for the safe generation of hydrogen for individual automobile and home use as a source of electricity.

The flexibility is extended by anodes and cathodes with larger surface area or by the connection of multiple insulated anodes to each other and multiple insulated cathodes connected to each other, wherein the rate of hydrogen production is controlled and the control is increased by an attached hydrogen storage tank, a pressure sensor, rheostat and cut-off switch to cut off the electricity causing the electrolysis. The addition of a breakable window between compartments C-1, C-3 and C-4 allows for the instant remix of NaOH+HCl+$H_2$ O residue with disproportionately created chlorine gas, in the event of a collision The Recycling Hydrogen Generator combines and thereby improves upon various common knowledge technologies which have been patented already or discovered while working with the chlor-alkali process in order to solve problems such as preventing dangerous, disproportionately created chlorine gases from entering the atmosphere and controlling the production of only a safe amount of hydrogen.

BRIEF DESCRIPTION OF THE SEVERAL VIEWS OF THE DRAWINGS

FIG. 1: depicts the recycling hydrogen generator. Internal Side View of chlorine gas filtration system FIG. 2: depicts the recycling hydrogen generator Internal Side View of expanded surface anode and cathode in expanded compartment comprised of compartments labeled C-1, C-2 and C-3.

FIG. 3: depicts the recycling hydrogen generator Top View of the expanded surface anode and cathode FIG. 4: depicts the recycling hydrogen generator Internal Side View of further expanded surface area comprising electrically connected, insulated wire mesh cylinders, where anodes are vented at one level and cathodes at a higher level.

FIG. 5: depicts the recycling hydrogen generator Internal End View of alternating wire mesh anodes and cathodes with venting system.

DETAILED DESCRIPTION OF THE INVENTION

In FIG. 1 Internal Side View of chlorine gas filtration system shows the division of the approximately 12"×8"×12" sturdy, acid-resistant plastic housing into five compartments labeled C#1-C#5. The Figure {it} shows in C#1 the anode used for electrolysis; a vent or digitally controlled, re-sealable opening on the upper side for the addition of more salt water, and a re-sealable tube adjacent to the anode for the extraction of chlorine gas into compartment C#4. Compartment C#1 is divided from compartment C#2 into substantially equal sections by a broken line representing the PEM (permeable ion-exchange membrane) or ion-selective membrane which allows hydrogen and oxygen atoms to pass through it (after electrolysis has split the NaCl molecules) but not the chlorine or sodium atoms or $H_2$ O molecules. A vent on the bottom of C#1 extends across the bottom of C#2, to allow the liquid remaining in both compartments, after electrolysis, to fall by gravity into compartment C#3. A breakable window on the left side of C#1 extends to the lower left side of C#3 for safety so that in case of accident, water and NaOH and HCl residue will mix with the dangerous chlorine gas contained in compartment C#4 immediately before any can enter the outside atmosphere due to damage to the outside housing or box, forming additional HCl, such as found in a normal car battery, which is much less dangerous than chlorine gas. FIG. 1 shows that compartment C#2 contains a cathode at the top with an adjacent closeable tube for the removal of hydrogen to a storage tank, and a vent for the addition of clean distilled water It shows that C#3 contains a vent on the lower left side for chlorine gas to be pumped from C#4 into the bottom of the solution in C#3 where the water or weak HCl serves as an additional filter (Filter 2) for the chlorine gases pumped into C#3, some of which will float to the surface, where a second vent above the solution level on the right side pumps any remaining chlorine gases created by disproportionality during electrolysis through a tube to the bottom of C#5 and a re-sealable vent on the bottom side which connects to the discharge or re-cycling tube for the liquid in C#3. FIG. 1 shows that compartment C#4 contains chlorine gas. It connects to the re-sealable chlorine gas tube adjacent to the anode in C#1. A vent on the bottom right internal wall allows the chlorine gas to be siphon pumped into the solution in C#3 to become HCl, and the breakable window that extends across the sides of both C#1 and C#3. Finally FIG. 1 shows that compartment C#5 has a vent and a tube from C#3 (above the solution level) to the bottom of C#5 where any remaining oxygen and chlorine gases can be filtered through a Na OH filter (Filter 3) and then 1a $BaO_2$ filter (Filter 4) before being released from the generator so that only oxygen is a byproduct In FIGS. 2 and 3, compartments C#4 and C#5 remain the same (although if C#3 also remains the same, the filtration system is improved), but the central combined compartment wherein C#1 and C#2 are combined by the elimination of the PEM and wherein this compartment can be expanded while C#3 is decreased in size has the addition of a very large surface zinc or zinc-plated or gold-plated (or half zinc-plated and half gold plated) titanium or steel anode (where zinc draws chlorine to it to form zinc-chloride, a solid which can be removed during maintenance cleaning while gold draws oxygen) and an equal size and shape rare metal or rare metal plated (preferably palladium which draws hydrogen) cathode. The zinc anode forms another filter (Filter 5) for removing chlorine gases, transforming them into less dangerous zinc-chloride.

FIG. 4 and FIG. 5 show an even larger surface anode and cathode system for a faster rate of hydrogen production comprising cylindrical or rectangular, zinc or gold plated wire mesh tubes as anodes and palladium-plated wire mesh tube cathodes, which are electrically connected anode to anode and cathode to cathode, but each individually insulated by a plastic wall sealed to the top of the said combined housing compartment C#1 and C#2 wherein this compartment can be expanded while C#3 is decreased in size, and wherein in the case of anodes the said insulating tube is sealed to the level 1 oxygen and chlorine vent and in the case of cathodes sealed to the level 2 hydrogen vent, but not touching the bottom of said combined housing compartment, where Na OH collects as a heavier molecule than hydrogen, oxygen or chlorine gas. There is a vent attached to the internal side wall of the said combined housing compartment to add fresh water. C#4 and C#5 remain the same, while C#3 is decreased in size or included in the said combined C#1 and C#2 retaining its vent above the liquid level entering compartment C#5, but a vent above each anode opens into a tube connected to C#4; while a vent above each cathode opens into a separate tube on a higher level for removal of hydrogen to a hydrogen storage tank. The said anodes and cathodes are spaced alternatively with anodes on one side of the said combined compartment and cathodes on the other so as to have access to the collection tube or vent level designated for them.

These variations in compartment, anode and cathode size in FIGS. 2, 3, 4, and 5 cause varying rates of hydrogen production requiring for potential safety standard regulation an external hydrogen storage tank attached to the other end of the hydrogen collector tube from the cathode vent, equipped with a pressure sensor, rheostat, and electrical cut-off switch to stop hydrogen production when the tank is full. An external vibration system is attached to the said housing to improve remixing of the Na OH+H Cl residue into Na Cl+$H_2O$; and is attached directly to the insulated palladium-plated cathode series to remove the hydrogen from the palladium cathode (Filter 6), which common knowledge in the industry has shown to be a problem especially in small enclosures which clog up easily, and is attached to the zinc-plated anode to remove the zinc-chloride from the zinc anode (Filter 5) unless this process is controlled manually or mechanically.

The invention claimed is:

1. A recycling hydrogen generator for producing hydrogen comprising:

a.) a multi-compartmented housing including an anode and cathode and sodium hydroxide and sodium chloride for producing hydrogen by electrolytic reaction;

b.) a safety filtration system comprising a liquid residue filter including water, sodium hydroxide (NaOH) and NaCl, a sodium hydroxide filter and a barium peroxide filter mounted in a sizeable multi-compartmented housing enabling the recycling of the dangerous chlorine gas byproduct of the electrolysis of hydrogen;

c.) wherein said anode and cathode are selected from the group consisting of zinc, plated precious metal, palladium metal and palladium plated metals, wherein said anodes and cathodes are in an alternating arrangement disposed within said multi-compartment housing for the production of hydrogen;

d.) further comprising means for vibration to urge loosening of said hydrogen from said cathode which is in operative connection with an external hydrogen storage tank and a pressure sensitive switch;

e.) and means for loosening said chlorine gas from said anode whereby said generator can be safely used for individual vehicles and buildings.

2. The recycling hydrogen generator of claim 1, wherein said multi-compartmented housing including an easily breakable window between said multi-compartmented housing, wherein said multi-compartment housing include $C_1$, $C_2$, $C_3$, $C_4$ and $C_5$ compartments wherein compartments $C_1$, $C_3$ and $C_4$ include said breakable window for mixing chlorine gas and liquid residue before damage to the housing allows chlorine gas to escape from said housing.

3. The recycling hydrogen generator of claim 2 wherein said compartment $C_4$ include means for containing chlorine gas generated from said electrolytic reaction in the production of hydrogen; further comprising a pressure sensitive electric switch for operating a resealable vent between said compartments $C_1$, $C_2$ and $C_3$ permitting the release of said liquid residue into compartment $C_3$; said switch in operative connection with a siphon pump for moving chlorine gas from said c4 compartment into said $C_3$ compartment containing said liquid residue whereby said chlorine gas is recycled and chemically converted into NaCl and HCl; and a second pressure sensitive electric switch for operating a second siphon pump for moving any remaining chlorine gas from the top of compartment $C_3$ into said $C_5$ compartment wherein the remaining chlorine gas is filtered through the NaOH filter and the barium peroxide filter before being released as hydrogen and oxygen into the atmosphere.

4. The recycling hydrogen generator of claim 1 wherein said pressure sensitive electric switch is connected to a source of power which controls the electrolytic reaction so that reaction is stopped with the hydrogen tank is full.

5. The recycling hydrogen generator of claim 1 wherein said cathode is a palladium plated cathode enclosed in one compartment of said multi-compartmented housing separated from the anode compartment and is in operative connection with said vibration means for loosening hydrogen depositions from said cathode, said hydrogen being stored in said external tank.

* * * * *